US008251122B2

(12) United States Patent
Gallego et al.

(10) Patent No.: US 8,251,122 B2
(45) Date of Patent: Aug. 28, 2012

(54) COMPENSATION GROOVES TO ABSORB DILATATION DURING INFILTRATION OF A MATRIX DRILL BIT

(75) Inventors: Gilles Gallego, Ibos (FR); Anthony Salliou, Pau (FR); Scott Buteaud, Spring, TX (US); Michael R. Reese, Houston, TX (US)

(73) Assignee: Varel Europe S.A.S., Pau (FR)

( * ) Notice: Subject to any disclaimer, the term of this patent is extended or adjusted under 35 U.S.C. 154(b) by 148 days.

(21) Appl. No.: 12/947,090

(22) Filed: Nov. 16, 2010

(65) Prior Publication Data

US 2011/0115118 A1 May 19, 2011

Related U.S. Application Data

(60) Provisional application No. 61/261,675, filed on Nov. 16, 2009.

(51) Int. Cl.
*B22D 19/04* (2006.01)
*B22C 9/00* (2006.01)

(52) U.S. Cl. ..... 164/9; 164/332

(58) Field of Classification Search ..... 164/6, 9, 164/112, 332, 333, 334; 249/187.1
See application file for complete search history.

(56) References Cited

U.S. PATENT DOCUMENTS

| | | | |
|---|---|---|---|
| 2,344,066 | A | 3/1944 | Taylor |
| 2,371,489 | A | 3/1945 | Williams, Jr. |
| 2,493,178 | A | 1/1950 | Williams, Jr. |
| 3,173,314 | A | 3/1965 | Blackmer |
| 3,175,260 | A | 3/1965 | Bridwell et al. |
| 3,757,878 | A | 9/1973 | Wilder et al. |
| 4,234,048 | A | 11/1980 | Rowley |
| 4,398,952 | A | 8/1983 | Drake |
| 4,423,646 | A | 1/1984 | Bernhardt |
| 4,460,053 | A | 7/1984 | Jurgens et al. |
| 4,499,795 | A | 2/1985 | Radtke |
| 4,667,756 | A | 5/1987 | King et al. |
| 4,884,477 | A | 12/1989 | Smith et al. |
| 5,373,907 | A | 12/1994 | Weaver |

(Continued)

FOREIGN PATENT DOCUMENTS

GB 2307699 6/1997

OTHER PUBLICATIONS

U.S. Appl. No. 13/013,365, filed Jan. 25, 2011, Gilles Gallego.

(Continued)

*Primary Examiner* — Kevin P Kerns
(74) *Attorney, Agent, or Firm* — King & Spalding LLP

(57) ABSTRACT

A down hole tool casting assembly, a gauge ring, and a method for preparing the gauge ring for use within the assembly. The gauge ring includes a bit diameter mold and one or more junk slot displacements extending inwardly from the interior surface of the bit diameter mold. The junk slot displacement includes a first end, a second end, and a junk slot displacement face extending from the first end to the second end. At least one groove is formed within the interior surface of the gauge ring, which alleviates stresses formed within the casting during the casting process. According to some embodiments, at least one groove is formed within the junk slot displacement face. According to some embodiments, at least one groove is formed within the interior surface of the bit diameter mold. Optionally, a pressure absorbing material is inserted into one or more grooves.

34 Claims, 4 Drawing Sheets

U.S. PATENT DOCUMENTS

| | | | | |
|---|---|---|---|---|
| 5,666,864 | A | 9/1997 | Tibbitts | |
| 5,732,783 | A | 3/1998 | Truax et al. | |
| 5,944,128 | A | 8/1999 | Truax et al. | |
| 6,045,750 | A | 4/2000 | Drake et al. | |
| 6,073,518 | A | 6/2000 | Chow et al. | |
| 7,398,840 | B2 | 7/2008 | Ladi et al. | |
| 8,061,408 | B2 * | 11/2011 | Reese et al. | 164/332 |
| 2008/0028891 | A1 | 2/2008 | Calnan et al. | |
| 2008/0156148 | A1 | 7/2008 | Smith et al. | |
| 2010/0101747 | A1 * | 4/2010 | Tomczak et al. | 164/9 |
| 2011/0084420 | A1 | 4/2011 | Reese et al. | |
| 2011/0121475 | A1 | 5/2011 | Reese et al. | |

OTHER PUBLICATIONS

U.S. Appl. No. 13/104,790, filed May 10, 2011, Reese et al.

* cited by examiner

COMPENSATION GROOVES TO ABSORB DILATATION DURING INFILTRATION OF A MATRIX DRILL BIT

RELATED APPLICATIONS

This application claims the benefit of U.S. Provisional Patent Application No. 61/261,675, entitled "Compensation Grooves To Absorb Dilatation During Infiltration Of A Matrix Drill Bit," filed Nov. 16, 2009, the entirety of which is incorporated by reference herein.

The present application is related to U.S. patent application Ser. No. 12/578,111, which issued as U.S. Pat. No. 8,061,408, entitled "Casting Method For Matrix Drill Bits And Reamers" and filed on Oct. 13, 2009, which is hereby incorporated by reference herein.

BACKGROUND

This invention relates generally to down hole tools and methods and apparatuses for manufacturing such items. More particularly, this invention relates to infiltrated matrix drilling products including, but not limited to, matrix drill bits, bi-center bits, core heads, and matrix bodied reamers and stabilizers, and the methods and apparatuses for manufacturing such items.

A matrix drill bit is typically fabricated using at least a graphite mold, a casting mandrel, or blank, positioned within the mold, and tungsten carbide matrix material placed within the mold and around the casting mandrel. The casting mandrel is typically much less expensive when compared to the cost of the tungsten carbide matrix material. According to one method for reducing the standard cost of matrix drill bit manufacturing, typically the diameter of the casting mandrel, or blank, is increased, thereby reducing the amount of expensive tungsten carbide matrix material used to form the drill bit casting. Thus, the thickness of the expensive tungsten carbide matrix material also is reduced.

However, increasing the diameter of the casting mandrel beyond a certain diameter causes problems with the drill bit manufacturing process. The thinner wall of matrix experiences intense pressure during the furnacing process due to the higher coefficient of thermal expansion of the steel casting mandrel, which oftentimes results in debilitating cracking in the final casting. This problem is especially prevalent when the junk slot displacements of the mold are directly milled into the graphite mold since graphite is essentially not compressible and is brittle. An ancillary problem is that the graphite mold can crack and leak due to the inability of the graphite matrix to accommodate the expansion pressure of the steel blank.

In view of the foregoing discussion, need is apparent in the art for improving the casting apparatus and/or the casting process so that the costs associated with casting fabrication are decreased. Additionally, a need is apparent for improving the casting apparatus and/or the casting process so that a smaller volume of tungsten carbide powder is used in the casting process. Further, a need is apparent for improving the casting apparatus and/or the casting process so that debilitating cracking in the final casting is eliminated or reduced. A technology addressing one or more such needs, or some other related shortcoming in the field, would benefit down hole drilling, for example fabricating castings more effectively and more profitably. This technology is included within the current invention.

BRIEF DESCRIPTION OF THE DRAWINGS

The forgoing and other features and aspects of the invention may be best understood with reference to the following description of certain exemplary embodiments, when read in conjunction with the accompanying drawings, wherein.

Figure 1:
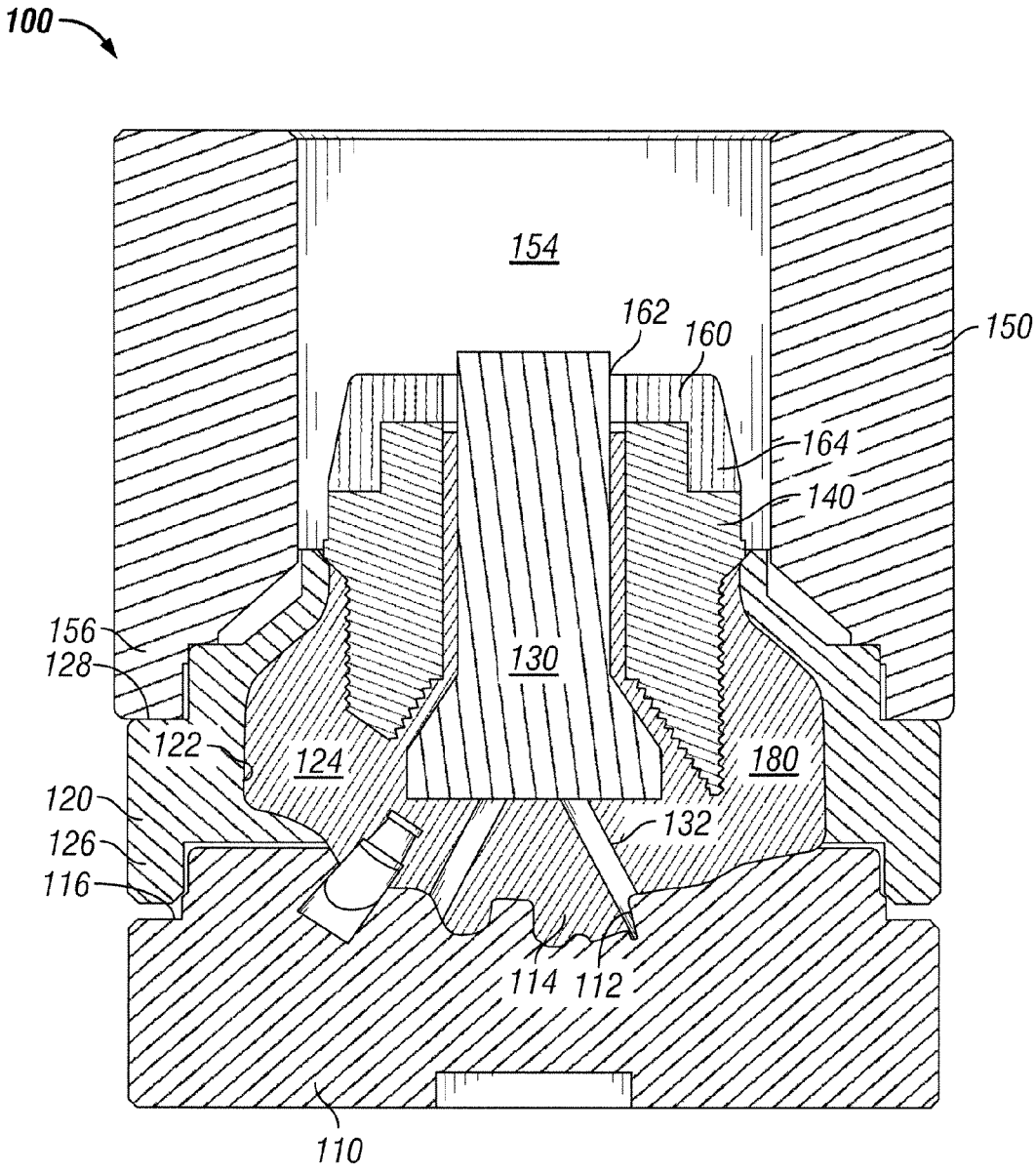
FIG. 1 is a cross-sectional view of a down hole tool casting assembly in accordance with an exemplary embodiment.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to infiltrated matrix drilling products including, but not limited to, matrix drill bits, bi-center bits, core heads, and matrix bodied reamers and stabilizers, and the methods and apparatuses for manufacturing such items. The invention is better understood by reading the following description of non-limiting, exemplary embodiments with reference to the attached drawings, wherein like parts of each of the figures are identified by like reference characters, and which are briefly described as follows.

FIG. 1 is a cross-sectional view of a down hole tool casting assembly 100 in accordance with an exemplary embodiment. Referring to FIG. 1, the down hole tool casting assembly 100 includes a lower mold 110, a gauge ring 120, a stalk 130, one or more nozzle displacements 132, a blank 140, a funnel 150, and a cap 160. According to some exemplary embodiments, the lower mold 110 and the gauge ring 120 are formed integrally as a single mold component. Additionally, according to some exemplary embodiments, the cap 160 is optional. Upon assembling the down hole tool casting assembly 100 in accordance with the description provided below, a matrix material 180 is deposited within the down hole tool casting assembly 100 and processed according to methods known to people having ordinary skill in the art to form the down hole tool (not shown). According to some exemplary embodiments, the down hole tool casting assembly 100 is used to fabricate a casting (not shown) of the down hole tool that allows for a larger diameter blank 140 to be used which displaces the more expensive matrix material 180. Thus, lesser amounts of the more expensive matrix material 180 is used when forming the down hole tool. However, according to some exemplary embodiments, the down hole tool casting assembly 100 is used to fabricate a casting of the down hole tool that allows for conventional diameter blanks to be used. According to some exemplary embodiments, the down hole tool casting assembly 100 is used to fabricate a casting (not shown) of the down hole tool that maintains or increases the current level of crack resistance afforded by conventional casting assemblies (not shown).

According to an exemplary embodiment shown in FIG. 1, the lower mold 110 is fabricated according to processes known to persons having ordinary skill in the art. The lower mold 110 has a precisely machined lower mold interior surface 112. The structure of the lower mold 110 forms a lower mold cavity 114 located within its interior portion and which is surrounded by the lower mold interior surface 112. The lower mold interior surface 112 has a shape that is a negative of what will become the facial features of the eventual bit cutting portion (not shown), which includes at least portions of one or more blades (not shown), at least portions of one or more junk slots (not shown) located between adjacent blades, and one or more cutters (not shown). The lower mold interior surface 112 is milled and dressed to form the proper contours of the finished bit cutting portion. Various types of cutters (not shown), known to persons having ordinary skill in the art, can be placed along the locations of the blades of the finished bit. These cutters can be placed during the bit casting process or after the bit has been fabricated via brazing or other methods known to persons having ordinary skill in the art.

The lower mold 110 is made from sand, hard carbon graphite, ceramic, or any other suitable material known to persons having ordinary skill in the art. Some advantages for using hard carbon graphite are that hard carbon graphite is easily machinable to tight tolerances, conducts furnace heat well, is dimensionally stable at casting temperatures, and provides for a smooth surface finish on the casting. According to some exemplary embodiments, the wall thickness of the lower mold 110 ranges from about three-eighths inch to about two and one-half inches. In other exemplary embodiments, the wall thickness of the lower mold 110 is greater than two and one-half inches and can be made as thick as desired. However, as the wall thickness of the lower mold 110 increases, the costs associated with fabricating the casting also increases.

According to some exemplary embodiments, a lower mold recess 116 is formed about the outer circumference of the top portion of the lower mold 110. This lower mold recess 116 facilitates coupling between the lower mold 110 and the gauge ring 120, which is discussed in further detail below.

Similarly, the gauge ring 120 is fabricated according to processes known to persons having ordinary skill in the art. The gauge ring 120 has a precisely machined gauge ring interior surface 122. The structure of the gauge ring 120 forms a gauge ring cavity 124 located within its interior portion and which is surrounded by the gauge ring interior surface 122. The gauge ring interior surface 122 has a shape that is a negative of what will become the facial features of the eventual bit gauge portion (not shown), which includes at least portions of one or more blades (not shown) and at least portions of one or more junk slots (not shown) positioned between adjacent blades. The gauge ring interior surface 122 is milled and dressed to form the proper contours of the finished bit gauge portion. In some exemplary embodiments, various types of cutters (not shown), known to persons having ordinary skill in the art, can be optionally placed along the blades of the gauge area of the bit. These cutters can be placed during the bit casting process or after the bit has been fabricated via brazing or other methods known to persons having ordinary skill in the art.

The gauge ring 120 is made from sand, hard carbon graphite, ceramic, or any other suitable material known to persons having ordinary skill in the art. Some advantages for using hard carbon graphite are that hard carbon graphite is easily machinable to tight tolerances, conducts furnace heat well, is dimensionally stable at casting temperatures, and provides for a smooth surface finish on the casting. According to some exemplary embodiments, the wall thickness of the gauge ring 120 ranges from about three-eighths inch to about two and one-half inches. In other exemplary embodiments, the wall thickness of the gauge ring 120 is greater than two and one-half inches and can be made as thick as desired. However, as the wall thickness of the gauge ring 120 increases, the costs associated with fabricating the casting also increases.

According to some exemplary embodiments, a gauge ring extender 126 is formed about the outer circumference of the bottom portion of the gauge ring 120. This gauge ring extender 126 facilitates coupling between the lower mold 110 and the gauge ring 120, wherein the gauge ring extender 126 is inserted into the lower mold recess 116. According to some exemplary embodiments, a gauge ring recess 128 is formed about the outer circumference of the top portion of the gauge ring 120. This gauge ring recess 128 facilitates coupling between the gauge ring 120 and the funnel 150, which is discussed in further detail below. Although one method for coupling the gauge ring 120 to the upper portion of the lower mold 110 is described, other methods known to persons having ordinary skill in the art can be used without departing from the scope and spirit of the exemplary embodiment.

Although the lower mold 110 and the gauge ring 120 are fabricated as two independent components, the lower mold 110 and the gauge ring 120 can be fabricated as a single component or in multiple components according to other exemplary embodiments. In some exemplary embodiments, the lower mold 110 and the gauge ring 120 are fabricated as a single component mold by using the technology embodied in currently pending U.S. patent application Ser. No. 12/180,276, entitled "Single Mold Milling Process For Fabrication Of Rotary Bits To Include Necessary Features Utilized For Fabrication In Said Process," which allows for a single mold body without the need for a separate gauge ring 120. U.S. patent application Ser. No. 12/180,276 is incorporated by reference herein in its entirety.

Once the lower mold 110 and the gauge ring 120 are assembled together, displacements are placed at least partially within the lower mold cavity 114 and the gauge ring cavity 124 of the lower mold 110 and the gauge ring 120, respectively. The displacements are typically fabricated from clay, sand, graphite, ceramic, or any other suitable material known to persons having ordinary skill in the art. These displacements include the center stalk 130 and the at least one nozzle displacement 132. The center stalk 130 is positioned substantially within the center of the gauge ring 120 and suspended a desired distance from the bottom of the lower mold's interior surface 112. The nozzle displacements 132 are positioned within the lower mold 110 and the gauge ring 120 and extend from the center stalk 130 to the bottom of the lower mold's interior surface 112. The center stalk 130 and the nozzle displacements 132 are removed subsequently from the eventual drill bit casting so that drilling fluid can flow though the center of the finished bit during the drill bit's operation.

The blank 140 is a cylindrical steel casting mandrel that is centrally suspended at least partially within the gauge ring 120 and around the center stalk 130. The blank 140 is positioned a predetermined distance down in the gauge ring 120 and extends closer to the bottom of the lower mold's interior surface 112 than the conventional blanks used in the prior art. For the same diameter casting, the blank 140 also has a diameter that is larger than the diameter of a conventional blank that is used in the prior art. This larger diameter blank 140 allows for a reduced consumption of matrix material 180 because the blank 140 occupies more volume. The placement of the blank 140 around the center stalk 130 within the gauge ring 120 creates a first space between the outer surface of the blank 140 and the interior surface 122 of the gauge ring 120 and a second space between the inner surface of the blank 140 and the outer surface of the stalk 130. According to one exemplary embodiment, the distance between at least a portion of the outer surface of the blank 140 and the interior surface 122 of the gauge ring 120 ranges from about four millimeters to about ten millimeters. According to another exemplary embodiment, the distance between at least a portion of the outer surface of the blank 140 and the interior surface 122 of the gauge ring 120 ranges from about five millimeters to about eight millimeters. In yet another exemplary embodiment, the distance between at least a portion of the outer surface of the blank 140 and the interior surface 122 of the gauge ring 120 is about five millimeters. Although this exemplary embodiment illustrates the larger diameter blank 140, the blank 140 can be dimensioned according to conventional blanks used in the prior art. Although this exemplary embodiment illustrates the blank 140 being fabricated from steel, other suitable materials known to people having ordinary skill in the art, including, but not limited to, steel alloys can be used without departing from the scope and spirit of the exemplary embodiment.

Once the displacements 130, 132 and the blank 140 have been positioned within the lower mold 110 and the gauge ring 120, the matrix material 180 is loaded into the lower mold 110 and the gauge ring 120 so that it fills a portion of the gauge ring cavity 124 that is around at least the lower portion of the blank 140, between a portion of the inner surfaces of the blank 140 and the outer surfaces of the center stalk 130, and between the nozzle displacements 132. The matrix material 180 is tungsten carbide powder or any other suitable material known to persons having ordinary skill in the art, including, but not limited to, any suitable powder metal. The matrix material 180 is angularly shaped, but can alternatively be spherically shaped or shaped in any other suitable geometric and/or non-geometric patterns. According to some exemplary embodiments, a shoulder powder (not shown) is loaded on top of the matrix material 180. The shoulder powder is made of tungsten powder or any other suitable material known to persons having ordinary skill in the art. The shoulder powder is angularly shaped, but can alternatively be spherically shaped or shaped in any other suitable geometric and/or non-geometric patterns. This shoulder powder acts to blend the casting to the steel and is machinable.

Once the matrix material 180 and the shoulder powder are loaded into the lower mold 110 and the gauge ring 120, the matrix material 180 and the shoulder powder are compacted within the lower mold 110 and the gauge ring 120. One method for compacting the matrix material 180 and the shoulder powder is to vibrate the lower mold 110 and the gauge ring 120 so that the matrix material 180 and the shoulder powder are compressed into a smaller volume. Although one method for compacting the matrix material 180 and the shoulder powder is described, other methods for compacting the matrix material 180 and the shoulder powder can be used, including application of force from above the matrix material 180 and the shoulder powder, without departing from the scope and spirit of the exemplary embodiment. Although the lower mold 110 and the gauge ring 120 are vibrated after the matrix material 180 and the shoulder powder are loaded into the lower mold 110 and the gauge ring 120, the vibration of the lower mold 110 and the gauge ring 120 can be done as an intermediate step before the shoulder powder is loaded on top of the matrix material 180.

The funnel 150 is a graphite cylinder that forms a funnel cavity 154 therein. The funnel 150 is coupled to the top portion of the gauge ring 120. A funnel extender 156 is formed about the outer circumference of the bottom portion of the funnel 150. This funnel extender 156 facilitates coupling between the gauge ring 120 and the funnel 150, wherein the funnel extender 156 is inserted into the gauge ring recess 128. Although this exemplary embodiment illustrates the funnel 150 being fabricated from graphite, other suitable materials known to people having ordinary skill in the art can be used without departing from the scope and spirit of the exemplary embodiment. Although one method for coupling the funnel 150 to the upper portion of the gauge ring 120 is described, other methods known to persons having ordinary skill in the art can be used without departing from the scope and spirit of the exemplary embodiment.

A binder material (not shown) is introduced into the funnel cavity 154, the gauge ring cavity 124, and the lower mold cavity 114 so that the binder material interacts with the matrix material 180 and the shoulder powder during heating of the down hole tool casting assembly 100. The binder material is a copper alloy or other suitable material known to persons having ordinary skill in the art. The proper amount of binder material that is to be used is calculable by persons having ordinary skill in the art. In one exemplary embodiment not shown, the binder material is introduced into the funnel cavity 154, the gauge ring cavity 124, and the lower mold cavity 114 using a binder pot (not shown) having an opening (not shown). In one example, the binder material is placed within the binder pot and the binder pot is coupled to the top portion of the funnel 150 via a recess (not shown) that is formed at the exterior edge of the binder pot. This recess facilitates the binder pot coupling to the upper portion of the funnel 150.

Once the down hole tool casting assembly 100 has been assembled and the binder pot is coupled to the funnel 150, a predetermined amount of binder material is loaded into the binder pot prior to being heated in a furnace (not shown) or other similar type structure, which is further described below. Although one method for coupling the binder pot to the funnel 150 is described, other methods known to persons having ordinary skill in the art can be used without departing from the scope and spirit of the exemplary embodiment.

According to some exemplary embodiments, an optional cap 160 is coupled to the upper portion of the blank 140 to prevent a metallurgical bond from forming between the binder material and the upper portion of the blank 140 during the casting process. This metallurgical bond is not formed because the cap 160 prevents the binder material from wetting the upper portion of the blank 140. In this embodiment, the cap 160 is coupled to and covers at least the top surface of the blank 140. The cap 160 is a thin cylindrical cap having an opening 162 extending through the center of the cap 160. The cap 160 includes a turned socket 164 at the end which couples to the upper portion of the blank 140. The turned socket 164 matches the geometric configuration of the top surface of the blank 140 so that the cap 160 couples to and covers the outer perimeter of the upper side portion of the blank 140. Although the cap 160 is circular in this embodiment, other exemplary embodiments can have a cap that is shaped in a square, rectangle, oval, or any other geometric or non-geometric shape. The cap 160 can be fabricated from graphite, ceramic, or any other suitable thermally stable material. Use of the cap 160 allows the excess solidified binder material, which is located within the funnel cavity 154, to be parted off and recovered in machining as a single piece. The recovered solidified binder material is approximately fifty percent of the original binder material weight and has a high purity because it has not been comingled with steel shavings from the traditional blank machining process. The pure binder material can then be sold or reprocessed, which results in increased cost savings.

The down hole tool casting assembly 100 along with the binder pot, according to one exemplary embodiment, is placed within a furnace (not shown) and is heated and controlled cooled as is known to persons having ordinary skill in the art. During the casting process, the binder material melts and flows into the matrix material 180 through the opening of the binder pot. In the furnace, the molten binder material infiltrates the casting material 180 and the shoulder powder, which also is referred to as the infiltration step. During this process, a substantial amount of binder material is used so that it fills at least a substantial portion of the funnel cavity 154. This excess binder material in the funnel cavity 154 supplies a downward force on the matrix material 180 and the shoulder powder.

During the casting process, the outside diameter of the blank 140 expands as the temperature increases, thereby putting pressure on the densely packed matrix material 180. The matrix material 180 transmits this pressure to the internal surface 122 of at least the gauge ring 120, thereby creating hoop stress. The gauge ring 120 is fabricated in a manner that alleviates and/or reduces these hoop stresses and prevents cracking of the gauge ring 120 and the casting, which is discussed in further detail below with respect to FIGS. 2 and 3.

Once the furnacing has been completed and the down hole tool casting assembly 100 has been control cooled, the funnel 150 and the binder pot are all recoverable for multiple reuses, if desired. The sacrificial gauge ring 120 and the lower mold 110 are broken away from the casting and discarded according to some exemplary embodiments. The casting is processed into a finished bit as is known by persons having ordinary skill in the art.

Figure 2:
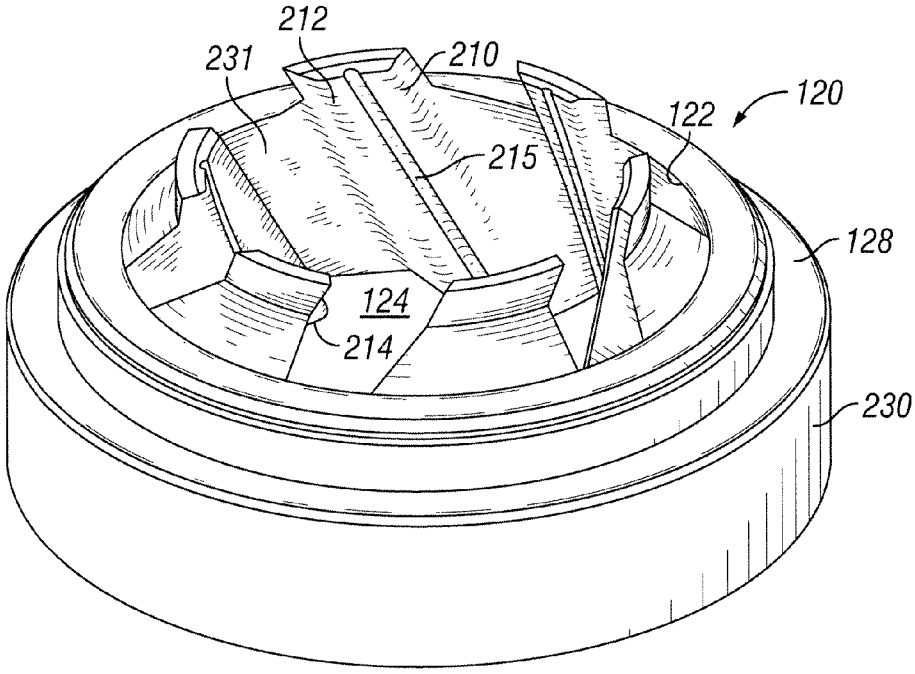
FIG. 2 is a top perspective view of the gauge ring as shown in FIG. 1 in accordance with an exemplary embodiment.

FIG. 2 is a top perspective view of the gauge ring 120 as shown in FIG. 1 in accordance with an exemplary embodiment. As previously mentioned, some exemplary embodiments include the gauge ring 120 and the lower mold 110 (FIG. 1) as a single component, while other exemplary embodiments include the gauge ring 120 and the lower mold 110 (FIG. 1) as multiple components. The gauge ring 120 includes a bit diameter mold 230 and one or more junk slot displacements 210 extending inwardly within the bit diameter mold 230.

According to some exemplary embodiments, the bit diameter mold 230 includes the gauge ring recess 128 formed about the outer circumference of the top portion of the bit diameter mold 230. This gauge ring recess 128 facilitates coupling between the bit diameter mold 230 and the funnel 150 (FIG. 1), as previously mentioned. Further, the bit diameter mold 230 includes an interior surface 231. According to some exemplary embodiments, the interior surface 231 of the bit diameter mold 230 is substantially circular; however, other geometric or non-geometric shapes can be used to shape the interior surface 231 without departing from the scope and spirit of the exemplary embodiment. According to some exemplary embodiments, the bit diameter mold 230 is substantially cylindrically shaped; however, the bit diameter mold 230 can be shaped into other geometric or non-geometric shapes without departing from the scope and spirit of the exemplary embodiments.

Each junk slot displacement 210 extends inwardly from the bit diameter mold's interior surface 231 and is positioned circumferentially around the interior surface 231. The junk slot displacement 210 includes a junk slot displacement face 212 extending angularly from about the top portion of the bit diameter mold 230 to about the bottom portion of the bit diameter mold 230 and one or more grooves 215 formed into the junk slot displacement face 212. The bit diameter mold's interior surface 231 in combination with the junk slot displacements 210 collectively form the gauge ring's interior surface 122. The grooves 215 extend generally axially along at least a portion of the length of the junk slot displacement face 212. In some exemplary embodiments, the junk slot displacement face 212 extends above the top portion of the bit diameter mold 230. In some exemplary embodiments, the junk slot displacement face 212 extends below the bottom portion of the bit diameter mold 230. Although some exemplary embodiments depict the junk slot displacement face 212 extending angularly from about the top portion of the bit diameter mold 230 to about the bottom portion of the bit diameter mold 230, other exemplary embodiments depict the junk slot displacement face 212 extending substantially vertically from about the top portion of the bit diameter mold 230 to about the bottom portion of the bit diameter mold 230. Each junk slot displacement 210 forms a junk slot (not shown) on the eventual bit casting, while each portion of the interior surface 231 positioned between adjacent junk slot displacements 210 forms a blade (not shown) on the eventual bit casting.

According to some exemplary embodiments, the junk slot displacement 210 is fabricated integrally with the bit diameter mold 230. However, in alternative exemplary embodiments, at least a portion of the junk slot displacement 210 is fabricated separately from the bit diameter mold 230 and thereafter coupled to the bit diameter mold 230 according to one or more methods known to people having ordinary skill in the art. In one example, the entire junk slot displacement 210 is separately formed from the bit diameter mold 230 and thereafter coupled to the interior surface 231 of the bit diameter mold 230 to form the gauge ring 120. In another example, a portion of the junk slot displacement 210 is integrally formed with the bit diameter mold 230 while the junk slot displacement face 212 is separately formed and thereafter coupled to the portion of the junk slot displacement 210 that was integrally formed with the bit diameter mold 230 to form the gauge ring 120.

The grooves 215 provide for a pressure relief mechanism to significantly reduce or eliminate the cracks formed in the casting during the fabrication process. Specifically, the grooves 215 provide for some space for the matrix material 180 (FIG. 1) to expand into when the matrix material 180 (FIG. 1) and the blank 140 (FIG. 1) are heated. According to some exemplary embodiments, a single groove 215 traverses the entire axial length of one or more junk slot displacement faces 212. In one example, the groove 215 substantially bisects the width of the junk slot displacement face 212 as it proceeds from the top of the junk slot displacement face 212 to the bottom of the junk slot displacement face 212; however, the groove 215 is not axially centered along the junk slot displacement face 212 according to other exemplary embodiments. Yet, in some exemplary embodiments, multiple grooves 215 traverse the entire axial length of one or more junk slot displacement faces 212. Alternatively, in some exemplary embodiments, one or more grooves 215 traverse a portion of the entire axial length of one or more junk slot displacement faces 212. For example, one or more grooves 215 traverse a portion of the entire axial length of the junk slot displacement face 212, wherein at least one groove 215 does not extend to either or both the top edge of the junk slot displacement face 212 or the bottom edge of the junk slot displacement face 212. In yet other exemplary embodiments, multiple grooves 215 are formed into one or more junk slot displacement faces 212, wherein at least one groove 215 lies parallel to at least one other groove 215. Further, in some exemplary embodiments, multiple grooves are formed into one or more junk slot displacement faces 212, wherein at least one groove 215 overlaps another groove 215 along a vertical axis. Further, in some exemplary embodiments, multiple grooves are formed into one or more junk slot displacement faces 212, wherein at least one groove 215 lies parallel to at least one other groove 215 and overlaps the other groove 215 along a vertical axis. According to some exemplary embodiments where at least one groove 215 overlaps the another groove 215 along a vertical axis, the grooves 215 collectively traverse at least a portion of the entire axial length of one or more junk slot displacement faces 212. According to some exemplary embodiments, one or more grooves 215 are positioned substantially in the same direction as the direction in which the junk slot displacement face 212 proceeds. Alternatively, one or more grooves 215 are positioned substantially at an angular direction compared to the direction in which the junk slot displacement face 212 proceeds. The grooves 215 can be formed in a combination of one or more of the previously described characteristics in accordance with one or more exemplary embodiments.

The grooves 215 are semi-circular in shape. However, according to other exemplary embodiments, the grooves 215 are shaped according to other geometric or non-geometric shapes. Alternatively, at least one groove 215 is shaped differently than at least one other groove 215.

Figure 3:
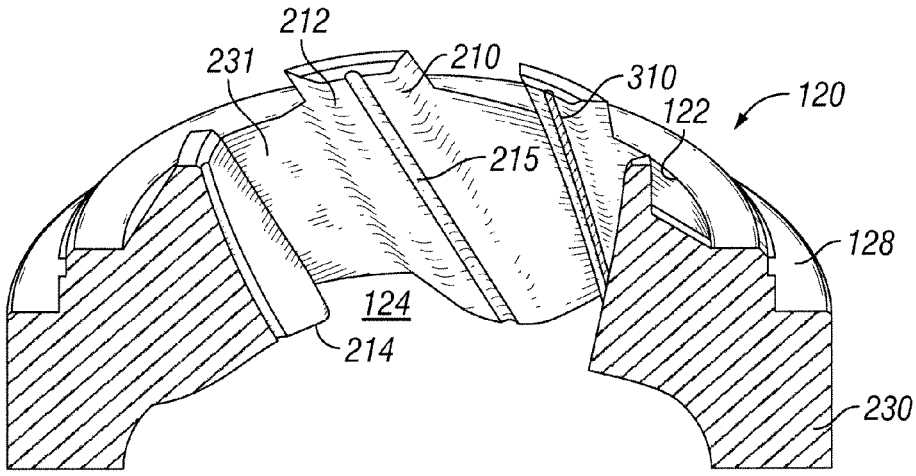
FIG. 3 is a cross-sectional view of the gauge ring as shown in FIG. 2 with a pressure absorbing material inserted within one or more grooves in accordance with an exemplary embodiment.

FIG. 3 is a cross-sectional view of the gauge ring 120 as shown in FIG. 2 having a pressure absorbing material 310 inserted within one or more grooves 215 in accordance with an exemplary embodiment. This insertion of the pressure absorbing material 310 within one or more grooves 215 is optional. According to some exemplary embodiments, the groove 215 is filled with the pressure absorbing material 310 to re-establish the desired junk slot displacement 210 shape so that the eventual junk slot of the casting also is the desired shape. The pressure absorbing material 310 assists the groove 215 to absorb the pressure caused by dilatation during the infiltration process. In one exemplary embodiment, the pressure absorbing material 310 is clay; however, other pressure absorbing materials known to people having ordinary skill in the art can be used without departing from the scope and spirit of the exemplary embodiment.

Referring to FIGS. 1-3, when using the gauge ring 120 with the pressure absorbing material 310 inserted within the grooves 215 during the fabrication process, the matrix material 180 is pressed into the pressure absorbing material 310 due to the expansion of the blank 140 and the matrix material 180 during the infiltration step of the fabrication process, or the heating step. Once the casting is cooled and broken out from the gauge ring 120, a barely perceptible ridge (not shown) of matrix material 180 exists where the matrix material 180 was pressed into the groove 215 having the pressure absorbing material 310 inserted therein during the infiltration step. The ridge may readily be ground off, if desired, to leave a uniform surface in the junk slot of the casting. Alternatively, the ridge is allowed to remain on the outer surface of the junk slot. Although the groove 215 is positioned on the junk slot displacement face 212 according to some exemplary embodiments; in practice, alternative exemplary embodiments include one or more grooves 215 being positioned along the interior surface 231 of the bit diameter mold 230, where the one or more grooves 215 are oriented in a generally axial manner similar to the orientation and placement of the grooves 215 on the junk slot displacement face 212, as mentioned above.

Some of the exemplary embodiments allow for manufacture of drill bits, or other down hole tools, having a thinner matrix thickness. According to some of the exemplary embodiments, the quantity of matrix material 180 used to manufacture the bit decreases about twenty percent; thereby reducing the manufacturing costs for the drill bit. Additionally, the volume of products scrapped due to cracking is reduced during the down hole tool fabrication.

FIGS. 4A-4H are front views of the junk slot displacement face 212 in accordance with several different exemplary embodiments. Although a few examples of the exemplary embodiments are described and illustrated, a person having ordinary skill in the art and having the benefit of the present disclosure realizes that many other embodiments of the invention are possible. For example, the number of grooves 215 are greater or fewer in other exemplary embodiments. Also, the orientation and/or the shape of the grooves 215 are different in other exemplary embodiments. Further, some of the features described in one embodiment is combinable with another feature described in another embodiment, to produce a different embodiment. Each of these embodiments are extensions of that which is described and are considered to be additional exemplary embodiments.

Figure 4A:
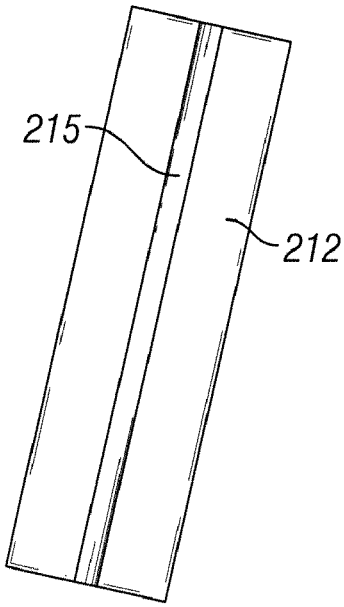
FIG. 4A is a front view of the junk slot displacement face in accordance with an exemplary embodiment.

FIG. 4A is a front view of the junk slot displacement face 212 in accordance with an exemplary embodiment. Referring to FIG. 4A, a single groove 215 traverses the entire axial length of the junk slot displacement face 212. The groove 215 substantially bisects the width of the junk slot displacement face 212 as it proceeds from the top of the junk slot displacement face 212 to the bottom of the junk slot displacement face 212. However, in other exemplary embodiments, the groove 215 does not axially bisect the width of the junk slot displacement face 212.

Figure 4B:
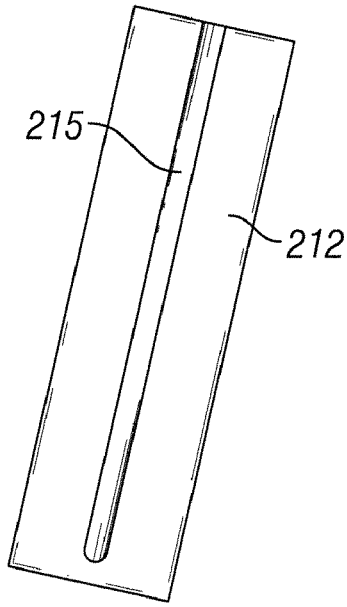
FIG. 4B is a front view of the junk slot displacement face in accordance with a second exemplary embodiment.

FIG. 4B is a front view of the junk slot displacement face 212 in accordance with a second exemplary embodiment. Referring to FIG. 4B, a single groove 215 traverses a portion of the entire axial length of the junk slot displacement face 212. More specifically, in FIG. 4B, a single groove 215 traverses a portion of the entire axial length of the junk slot displacement face 212, wherein the groove 215 does not extend to the bottom edge of the junk slot displacement face 212. However, in other exemplary embodiments, the groove 215 traverses a portion of the entire axial length of the junk slot displacement face 212, wherein the groove 215 extends to the bottom edge of the junk slot displacement face 212 but does not extend to the top edge of the junk slot displacement face 212.

Figure 4C:
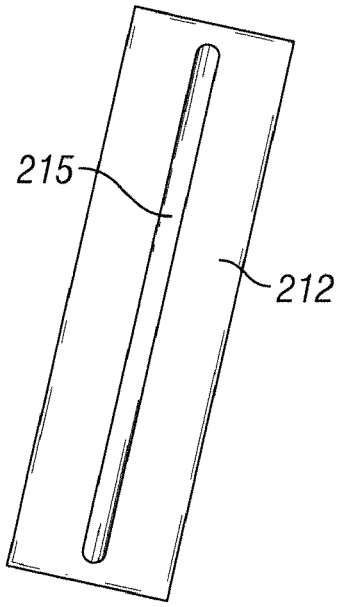
FIG. 4C is a front view of the junk slot displacement face in accordance with a third exemplary embodiment.

FIG. 4C is a front view of the junk slot displacement face 212 in accordance with a third exemplary embodiment. Referring to FIG. 4C, a single groove 215 traverses a portion of the entire axial length of the junk slot displacement face 212. More specifically, in FIG. 4C, a single groove 215 traverses a portion of the entire axial length of the junk slot displacement face 212, wherein the groove 215 does not extend to both the top edge of the junk slot displacement face 212 and the bottom edge of the junk slot displacement face 212.

Figure 4D:
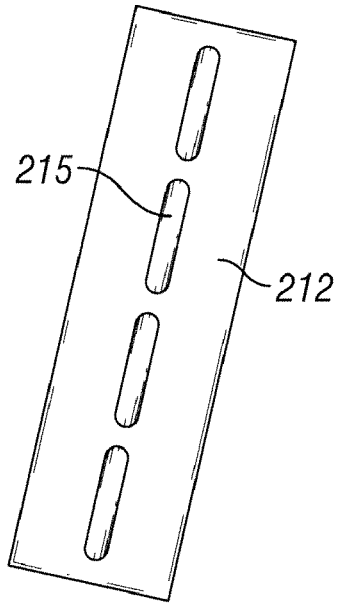
FIG. 4D is a front view of the junk slot displacement face in accordance with a fourth exemplary embodiment.

FIG. 4D is a front view of the junk slot displacement face 212 in accordance with a fourth exemplary embodiment. Referring to FIG. 4D, multiple grooves 215 are formed into the junk slot displacement face 212, wherein each groove 215 is axially aligned with another groove 215. However, in other exemplary embodiments, at least one groove 215 is not axially aligned with at least another groove 215.

Figure 4E:
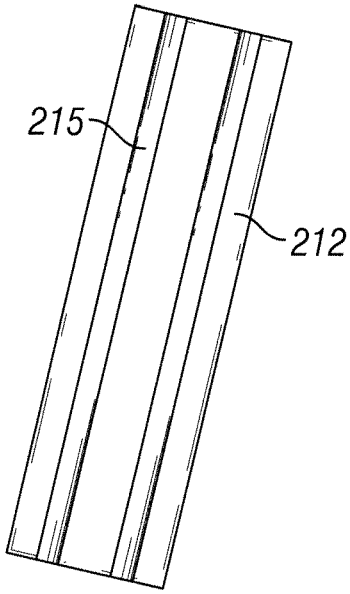
FIG. 4E is a front view of the junk slot displacement face in accordance with a fifth exemplary embodiment.

FIG. 4E is a front view of the junk slot displacement face 212 in accordance with a fifth exemplary embodiment. Referring to FIG. 4E, two grooves 215 are formed into the junk slot displacement face 212, wherein each groove 215 traverses the entire axial length of the junk slot displacement face 212. Each of the grooves 215 is parallel to another groove 215. However, in other exemplary embodiments, at least one groove 215 is not parallel to at least one other groove 215.

Figure 4F:
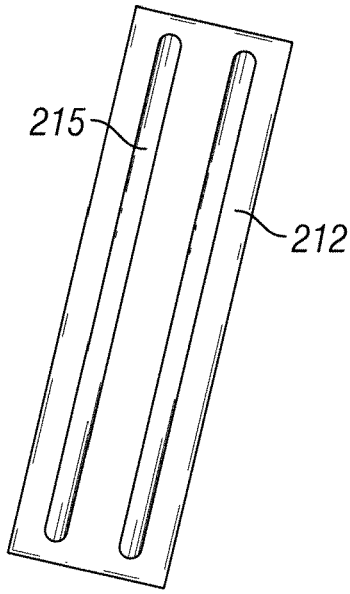
FIG. 4F is a front view of the junk slot displacement face in accordance with a sixth exemplary embodiment.

FIG. 4F is a front view of the junk slot displacement face 212 in accordance with a sixth exemplary embodiment. Referring to FIG. 4F, two grooves 215 are formed into the junk slot displacement face 212, wherein each groove 215 traverses a portion of the entire axial length of the junk slot displacement face 212. More specifically, in FIG. 4F, both grooves 215 traverse a portion of the entire axial length of the junk slot displacement face 212, wherein each groove 215 does not extend to both the top edge of the junk slot displacement face 212 and the bottom edge of the junk slot displacement face 212. Each of the grooves 215 is parallel to another groove 215. However, in other exemplary embodiments, at least one groove 215 is not parallel to at least one other groove 215.

Figure 4G:
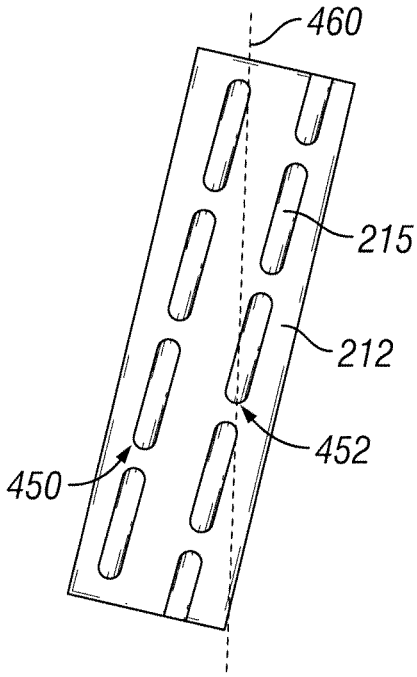
FIG. 4G is a front view of the junk slot displacement face in accordance with a seventh exemplary embodiment.

FIG. 4G is a front view of the junk slot displacement face 212 in accordance with a seventh exemplary embodiment. Referring to FIG. 4G, multiple grooves 215 are formed into the junk slot displacement face 212, wherein a portion of the multiple grooves 215 are axially aligned to form a first groove column 450 and wherein a remaining portion of the multiple grooves 215 are axially aligned to form a second groove column 452. Each of the first groove column 450 and the second groove column 452 substantially traverse the axial length of the junk slot displacement face 212. The first groove column 450 is substantially parallel to the second groove column 452. However, in other exemplary embodiments, the first groove column 450 is not substantially parallel to the second groove column 452. According to FIG. 4G, the upper end of at least one groove 215 of one of the first groove column 450 and the second groove column 452 overlaps the lower end of at least one groove 215 of the other column 450 and 452 in the direction of a vertical axis 460. However, according to some exemplary embodiments, the upper end of at least one groove 215 of one of the first groove column 450 and the second groove column 452 overlaps the lower end of at least one groove 215 of the other column 450 and 452 in the direction of the axial length of the junk slot displacement face 212. Also according to FIG. 4G, the grooves 215 of both the first groove column 450 and the second groove column 452 collectively traverse the entire axial length of the junk slot displacement face 212. However, in some exemplary embodiments, the grooves 215 of both the first groove column 450 and the second groove column 452 collectively traverse a portion of the entire axial length of the junk slot displacement face 212. Although groove columns 450 and 452 are shown as being formed, the grooves may not form columns in some exemplary embodiments.

Figure 4H:
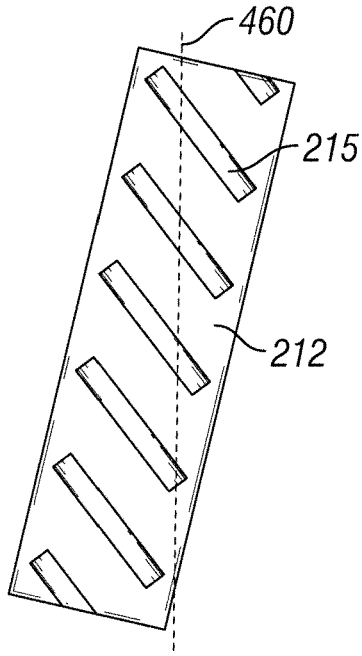
FIG. 4H is a front view of the junk slot displacement face in accordance with an eighth exemplary embodiment.

FIG. 4H is a front view of the junk slot displacement face 212 in accordance with an eighth exemplary embodiment. Referring to FIG. 4H, multiple grooves 215 are formed into the junk slot displacement face 212, wherein each groove 215 traverses a portion of the axial length of the junk slot displacement face 212, but collectively traverse the entire axial length of the junk slot displacement face 212. However, in other exemplary embodiments, the grooves 215 collectively traverse a portion of the entire axial length of the junk slot displacement face 212 Each groove 215 is oriented parallel to the remaining grooves 215. However, in some exemplary embodiments, at least one groove 215 is not parallel to at least one other groove 215. Each grove 215 is oriented at an angle substantially forty-five degrees from the direction of the axial length of the junk slot displacement face 212; however, one or more grooves 215 are oriented in angles greater than or less than forty-five degrees from the direction of the axial length of the junk slot displacement face 212 according to some alternative exemplary embodiments. According to FIG. 4H, the upper end of at least one groove 215 overlaps the lower end of at least one other groove 215 in the direction of the vertical axis 460. However, according to some exemplary embodiments, the upper end of at least one groove 215 overlaps the lower end of at least one other groove 215 in the direction of the axial length of the junk slot displacement face 212.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

We claim:

1. A gauge ring, comprising:

a bit diameter mold comprising an interior surface;

one or more junk slot displacements extending inwardly from the interior surface of the bit diameter mold, the junk slot displacement comprising:

a first end;

a second end; and a junk slot displacement face extending from the first end to the second end; and at least one groove formed within an interior surface of the gauge ring, wherein the interior surface of the bit diameter mold and the junk slot displacement face collectively form at least a portion of the interior surface of the gauge ring.

2. The gauge ring of claim 1, wherein the grooves are formed on the junk slot displacement face.

3. The gauge ring of claim 2, wherein at least one groove extends from the first end to the second end.

4. The gauge ring of claim 3, wherein the groove substantially bisects the width of the junk slot displacement face.

5. The gauge ring of claim 2, wherein at least one groove extends a portion of the distance between the first end and the second end.

6. The gauge ring of claim 5, wherein the at least one groove extends to the first end.

7. The gauge ring of claim 2, wherein a plurality of grooves are substantially axially aligned across the length of the junk slot displacement face, wherein the plurality of grooves collectively extend substantially the length of the junk slot displacement face.

8. The gauge ring of claim 2, wherein a first plurality of grooves form a first groove column, a second plurality of grooves form a second groove column, the first groove column and the second groove column collectively extending substantially the length of the junk slot displacement face.

9. The gauge ring of claim 8, wherein the first groove column is substantially parallel to the second groove column.

10. The gauge ring of claim 8, wherein a top portion of at least one groove of one of the first groove column and the second groove overlaps a bottom portion of at least one groove of the other groove column in the direction of the length of the junk slot displacement face.

11. The gauge ring of claim 8, wherein a top portion of at least one groove of one of the first groove column and the second groove overlaps a bottom portion of at least one groove of the other groove column in the direction of a vertical axis of the junk slot displacement face.

12. The gauge ring of claim 2, wherein at least one groove is oriented at an angle from the direction of the length of the junk slot displacement face, the plurality of grooves collectively extending substantially the length of the junk slot displacement face.

13. The gauge ring of claim 12, wherein a first groove is parallel to a second groove.

14. The gauge ring of claim 12, wherein the angle is about forty-five degrees.

15. The gauge ring of claim 12, wherein a top portion of at least one groove overlaps a bottom portion of a second groove in the direction of the length of the junk slot displacement face.

16. The gauge ring of claim 12, wherein a top portion of at least one groove overlaps a bottom portion of a second groove in the direction of a vertical axis of the junk slot displacement face.

17. The gauge ring of claim 1, wherein at least one groove is filled with a pressure absorbing material.

18. The gauge ring of claim 17, wherein the pressure absorbing material is clay.

19. A down hole tool casting assembly, comprising:

a blank;

a gauge ring comprising:

a bit diameter mold comprising an interior surface;

one or more junk slot displacements extending inwardly from the interior surface of the bit diameter mold, the junk slot displacement comprising:

a first end;

a second end; and a junk slot displacement face extending from the first end to the second end; and at least one groove formed within an interior surface of the gauge ring, wherein the interior surface of the bit diameter mold and the junk slot displacement face collectively form at least a portion of the interior surface of the gauge ring, the interior surface of the gauge ring surrounding at least a portion of the blank.

20. The down hole tool casting assembly of claim 19, wherein the grooves are formed on the junk slot displacement face.

21. The down hole tool casting assembly of claim 20, wherein at least one groove extends at least a portion of the distance between the first end and the second end.

22. The down hole tool casting assembly of claim 20, wherein a first plurality of grooves form a first groove column, a second plurality of grooves form a second groove column, the first groove column and the second groove column collectively extending substantially the length of the junk slot displacement face.

23. The down hole tool casting assembly of claim 22, wherein a top portion of at least one groove of one of the first groove column and the second groove overlaps a bottom portion of at least one groove of the other groove column in the direction of the length of the junk slot displacement face.

24. The down hole tool casting assembly of claim 22, wherein a top portion of at least one groove of one of the first groove column and the second groove overlaps a bottom portion of at least one groove of the other groove column in the direction of a vertical axis of the junk slot displacement face.

25. The down hole tool casting assembly of claim 20, wherein at least one groove is oriented at an angle from the direction of the length of the junk slot displacement face, the plurality of grooves collectively extending substantially the length of the junk slot displacement face.

26. The down hole tool casting assembly of claim 25, wherein a top portion of at least one groove overlaps a bottom portion of a second groove in the direction of the length of the junk slot displacement face.

27. The down hole tool casting assembly of claim 25, wherein a top portion of at least one groove overlaps a bottom portion of a second groove in the direction of a vertical axis of the junk slot displacement face.

28. The down hole tool casting assembly of claim 19, wherein at least one groove is filled with a pressure absorbing material.

29. The down hole tool casting assembly of claim 19, wherein the distance between the outer surface of the blank and a portion of the interior surface of the gauge ring ranges from about four millimeters to about ten millimeters.

30. The down hole tool casting assembly of claim 19, wherein the distance between the outer surface of the blank and a portion of the interior surface of the gauge ring ranges from about five millimeters to about eight millimeters.

31. A method for preparing a gauge ring for use within a down hole tool casting assembly, the method comprising:

obtaining a gauge ring, the gauge ring comprising:

a bit diameter mold comprising an interior surface;

one or more junk slot displacements extending inwardly from the interior surface of the bit diameter mold, the junk slot displacement comprising:

a first end;

a second end; and a junk slot displacement face extending from the first end to the second end, wherein the interior surface of the bit diameter mold and the junk slot displacement face collectively form at least a portion of the interior surface of the gauge ring; and forming at least one groove within an interior surface of the gauge ring.

32. The method of claim 31, wherein at least one groove is formed on one or more junk slot displacement faces.

33. The method of claim 31, wherein at least one groove is formed on the interior surface of the bit diameter mold.

34. The method of claim 31, further comprising inserting a pressure absorbing material within at least one groove.

* * * * *